US006251089B1

(12) United States Patent
Kuznets et al.

(10) Patent No.: US 6,251,089 B1
(45) Date of Patent: Jun. 26, 2001

(54) BODY AND JOINTS MASSAGE DEVICE

(75) Inventors: Lev Kuznets; Yoram Chen, both of Beer Sheva (IL)

(73) Assignee: Vital-Tech Ltd., Midreshet Sede Boqer (IL)

( * ) Notice: Subject to any disclaimer, the term of this patent is extended or adjusted under 35 U.S.C. 154(b) by 0 days.

(21) Appl. No.: 09/142,917

(22) PCT Filed: Mar. 19, 1997

(86) PCT No.: PCT/US97/04267

§ 371 Date: Sep. 18, 1998

§ 102(e) Date: Sep. 18, 1998

(87) PCT Pub. No.: WO97/34561

PCT Pub. Date: Sep. 25, 1997

(51) Int. Cl.[7] ..... A61H 7/00

(52) U.S. Cl. ..... 601/95; 601/93; 601/112; 601/134

(58) Field of Search ..... 601/84, 89, 93, 601/95, 97, 101, 103, 112, 134, 135, 133, 85, 87

(56) References Cited

U.S. PATENT DOCUMENTS 1,577,751 * 3/1926 Paschall ..... 601/87

FOREIGN PATENT DOCUMENTS

813751 * 7/1951 (DE) ..... 601/87

* cited by examiner

*Primary Examiner*—Mickey Yu
*Assistant Examiner*—Benjamin Koo

(57) ABSTRACT

This invention is a body and joints massage device having changeable massage heads to obtain selected stroking, rubbing and/or kneading massaging effects of all body parts including body joints. The body and joints massage device comprises a shaft housing (22) engaging a main rotating shaft (24), the shaft housing being formed suitable to grip by a user and may be engaged with different types of massage heads. One type includes actively rotating and actively self-rotating massage elements (40) each equipped with passively rotating rollers for body stroking and rubbing massage effects. Another type includes actively rotating, flexible and/or extended massage elements (74) each of which also performs an active or passive reciprocal linear or arc movement for body and/or joints massage effect. Yet another type includes actively rotating extended massage elements (176), in which each also performs an active or passive reciprocal arc movement for body and joints massage.

2 Claims, 12 Drawing Sheets

FIG. 6a
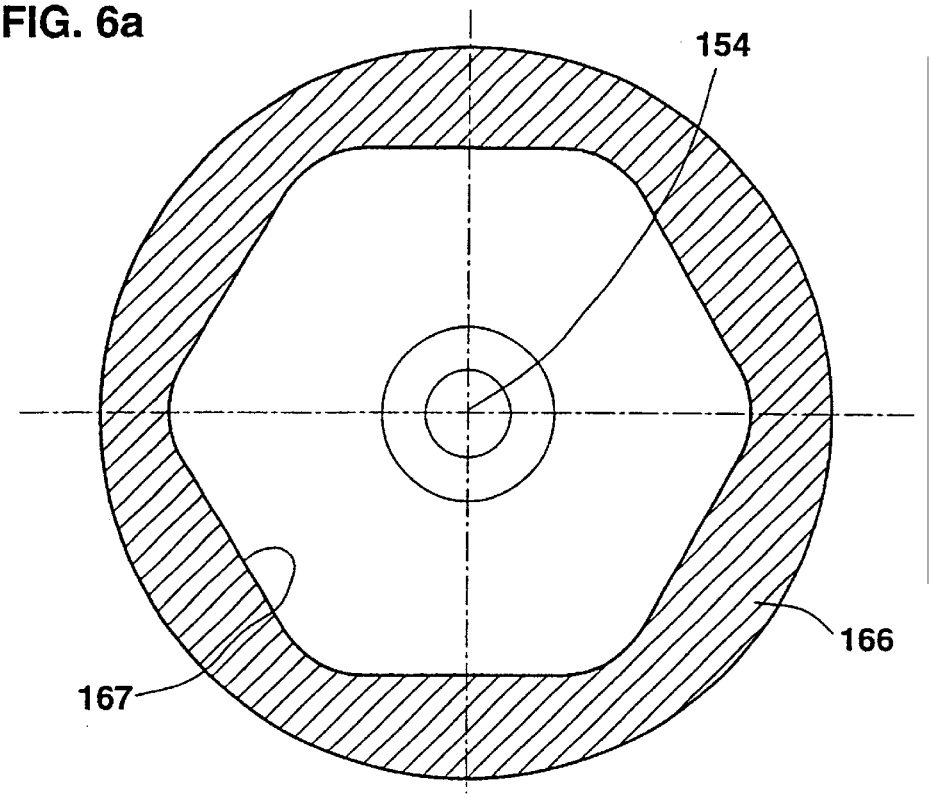
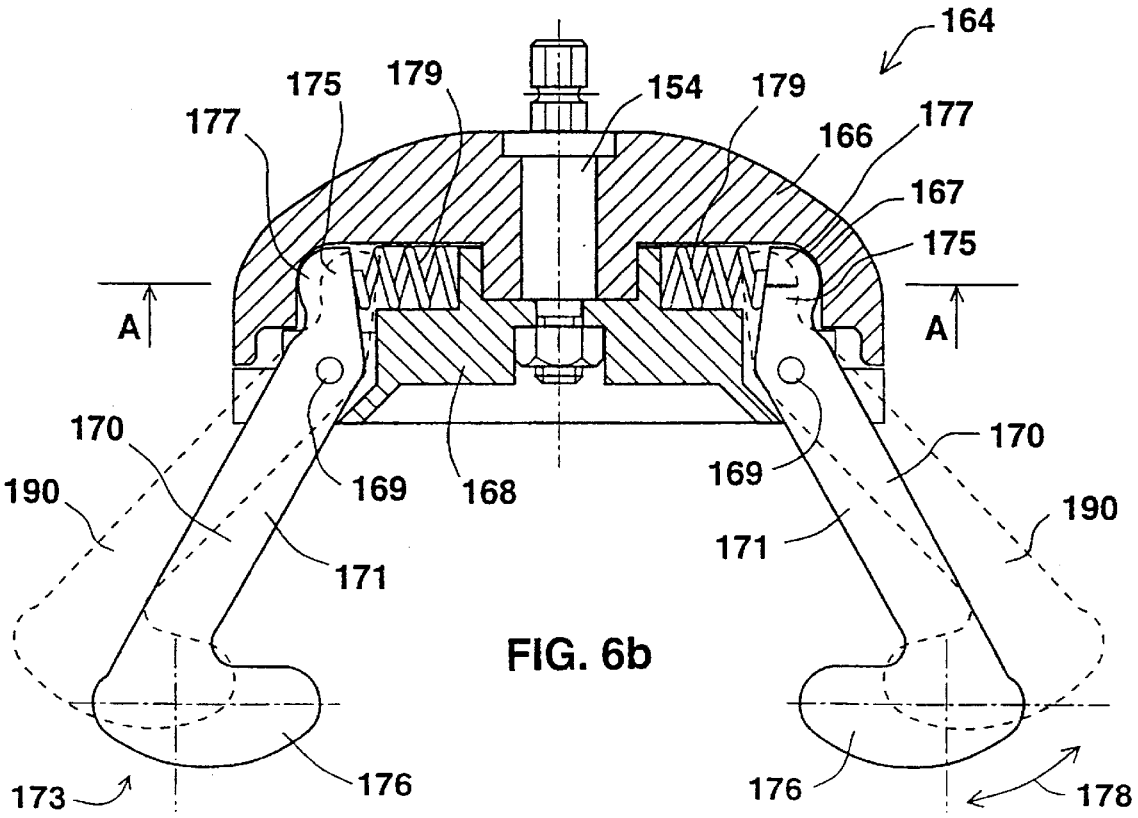
FIG. 6b

FIG.7
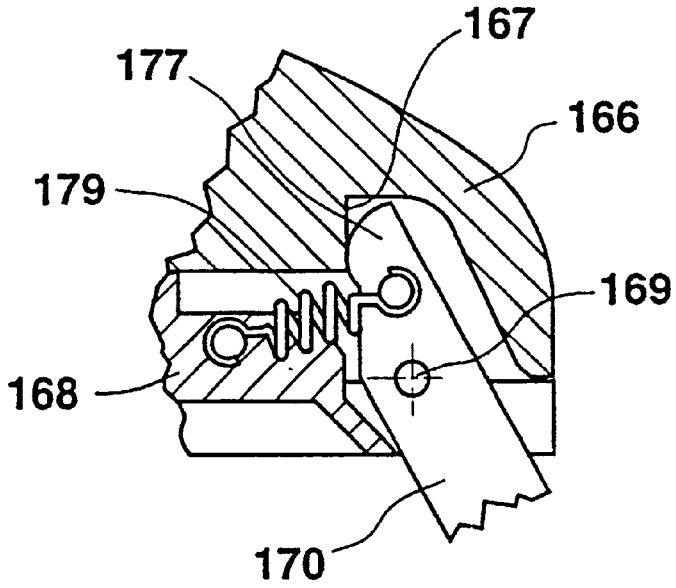
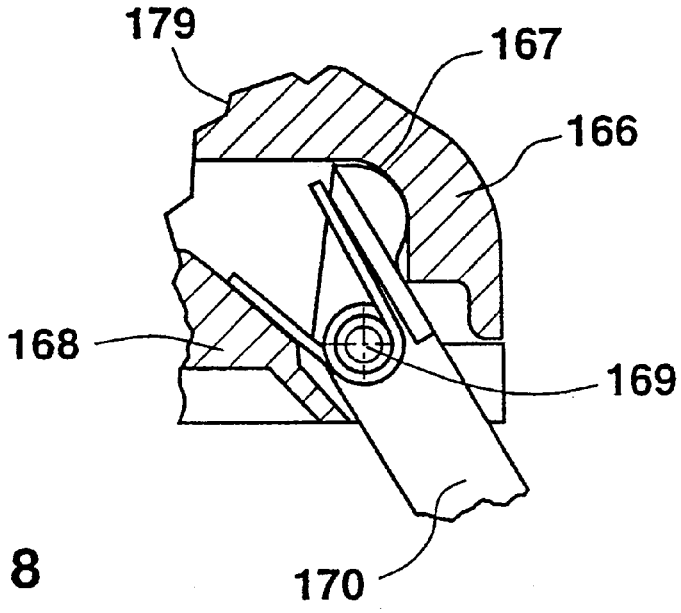
FIG. 8

BODY AND JOINTS MASSAGE DEVICE

FIELD AND BACKGROUND OF THE INVENTION

The present invention relates in general to a massage device. More particularly the present invention relates to a hand held, electrically operated body and/or joints massage device having changeable massage heads to obtain selected stroking, rubbing and/or kneading massaging effects of all body parts including body joints such as heels, elbows, knees and shoulders.

A body massage may be divided into three levels of rising intensities. The first level, known in the art as stroking, involves a smoothing action characterized by mild to medium pressure applied onto a body part being massaged. Stroking is meant to warm-up and thereby prepare the body part being massaged to the following massage levels. The second level, known in the art as rubbing, involves a pressing and rubbing action characterized by movement of the tissue and medium to high pressure applied onto the body part being massaged. Rubbing is meant to increase the blood flow in the body part being massaged and thereby to prepare that body part to the third level. The third level, known in the art as kneading, involves a pressing and kneading actions characterized by high pressure applied onto the body part being massaged. Kneading is typically a deep and thorough muscle massage meant to bring about muscle relaxation.

The three levels of the body massage thus described are typically manually applied by the hands of a massagist (e.g., a physiotherapist) onto selected body parts of a treated individual. This process involves a hard labor by the massagist and typically extends over a relatively prolonged time (30) minutes or more).

Thus, over the years various types of mechanical massage devices have been introduced to the art for different massaging applications. Typically, each of these massage devices includes a motor and a movement transmission mechanism for transmission of movement, a massage head or a platform and protruding massage elements to be contacted with the body part being massaged.

These massage devices may be categorized according to the movements of massage elements associated with their operation. These movements are of three kinds, (i) a rotational movement of the massage head, referred to hereinbelow as a type I movement, (ii) a radial or conical rotational movement of each of the massage elements, referred to hereinbelow as a type II movement and (iii) a linear reciprocal movement of each of the massage elements, referred to hereinbelow as a type III movement.

Most of the prior art massage elements perform only one kind of movement. For example: (a) U.S. Pat. No. 1,899,208 to Murphy, U.S. Pat. No. 2,519,790 to Quinn, U.S. Pat. No. 2,203,976 to Auyagi and U.S. Pat. No. 2,670,733 to Gordon disclose massage devices characterized by a rotational movement of the massage head (type I); (b) U.S. Pat. No. 1,931,849 to Matson, U.S. Pat. No. 2,232,493 to Stuckey et al., U.S. Pat. No. 3,499,439 to Boller, U.S. Pat. No. 4,733,655 to Smal and U.S. Pat. No. 5,183,034 to Yamasaki et al., disclose massage devices characterized by either a radial or a conical rotational movement of each of the massage elements (type II); and (c) U.S. Pat. No. 2,067,991 to Taylor, U.S. Pat. No. 3,228,392 to Speyer and U.S. Pat. No. 5,311,860 to Doria, disclose massage devices characterized by a linear reciprocal movement of each of the massage elements (type III). Since only a single type of movement is associated with these and similar massage devices they are limited in their massaging effects.

Some prior art massage devices are characterized by a superposition of two of the above mentioned movement types. For example, U.S. Pat No. 1,777,151 to Muttger-Pelli discloses a massage device having a head equipped with concentrically arranged balls each rotating around a center point (i.e., type I movement), and at the same time each of the balls can also rotate so that each of the balls travels a small circular path (i.e., type II movement). The massage device of Muttger-Pelli further includes selecting means (in the form of pin 24, as shown in FIG. 1 there) for selecting between two modes of operation, wherein according to the first mode of operation both type I and type II movements are simultaneously actuated, whereas according to the second mode of operation only type I movement is actuated.

U.S. Pat. No. 5,447,491 to Bellandi discloses massaging devices having a head equipped with plurality of massage elements. The massaging devices of Bellandi are equipped with a horizontal cam, and can perform type I and/or type III movements, yet Bellandi fails to describe selecting means for selecting from these types of movements.

All of the prior art massage devices described hereinabove offer limited massaging effects and are in some cases specialized for limited massaging applications. Furthermore, non of the above devices is suitable for body joints massage.

There is thus a widely recognized need for, and it would be highly advantageous to have, a body and joints massage device having changeable operating massage heads to obtain selected stroking, rubbing and/or kneading massaging effects of all body parts and massage of body joints such as heels, elbows, knees and shoulders.

SUMMARY OF THE INVENTION

According to the present invention there is provided a body and joints massage device having changeable massage heads to obtain selected stroking, rubbing and/or kneading massaging effects of all body parts and massage of body joints such as heels, elbows, knees and shoulders.

According to further features in preferred embodiments of the invention described below, the massage device comprising (a) a shaft housing engaging a main rotating shaft, the shaft housing being formed suitable to grip by a user; and (b) a massage head being engaged by the shaft housing, the massage head including (i) a transmission means housing engaging rotational movement transmission mechanism, the rotational movement transmission mechanism including (1) a central transmission center being connected to the main shaft; and (2) at least one peripheral transmission center being rotated via the central transmission center, each of the at least one peripheral transmission centers being connected to an axis, the axis being rotatably accommodated in a fixed location in the transmission means housing; and (ii) at least one massage element, each of the at least one massage elements being connected to one of the at least one peripheral transmission centers rotating therewith, each of the at least one massage elements including at least one passively rotating roller.

According to still further features in the described preferred embodiments the transmission centers are selected from the group consisting of gear transmission and belt transmission.

According to still further features in the described preferred embodiments each of the rollers is formed having recessions.

According to still further features in the described preferred embodiments each of the two passively rotating rollers of each of the at least one massage elements rotates either independently or synchronously.

According to further features in preferred embodiments of the invention the at least one passively rotating roller is rocking.

According to further features in preferred embodiments of the invention described below, the massage device comprising (a) a shaft housing engaging a main rotating shaft, the shaft housing being formed suitable to grip by a user; and (b) a massage head being engaged by the shaft housing, the massage head including (i) a transmission means housing engaging a base, the base being connected to or integrally formed with the main rotating shaft, rotating therewith, the base having an inner side facing the transmission means housing and an outer side; (ii) at least one massage element, each of the at least one massage elements being peripherally movably connected to the base, rotating therewith, each of the at least one massage elements having a first end protruding from the inner side of the base towards the transmission means housing and a second end protruding from the outer side of the base, the second end being engaged by a skin engaging member; (iii) first means for providing each of the at least one massage elements with an active reciprocal linear movement, the active reciprocal linear movement being substantially parallel to the shaft; and (iv) second means for providing each of the at least one massage elements with a passive flexible conical random movement, the passive flexible conical random movement being substantially orthogonal to the active reciprocal linear movement.

According to still further features in the described preferred embodiments the first means includes a cam engaged in the transmission means housing, the cam has a reciprocal structure protruding from the transmission means housing towards the base, wherein the first end of each of the at least one massage elements is pressed against the cam, the press is affected by biasing means pressing the first end towards the cam.

According to still further features in the described preferred embodiments the first means includes a cam engaged in the transmission means housing, the cam has a reciprocal structure protruding from the transmission means housing towards the base, wherein the first end of each of the at least one massage elements is pressed against the cam only when the massage element is in contact with the body of a user, whereas the first end of each of the at least one massage elements is kept away from the cam by a biassing means when the massage element is not in contact with the body of the user.

According to still further features in the described preferred embodiments the second means includes a mechanism implemented in the massage element, the mechanism is selected from the group consisting of a discontinuous axle including a ball joint, a universal joint and a continuous flexible axle.

According to still further features in the described preferred embodiments the second means includes a mechanism implemented in the main rotating shaft, the mechanism is selected from the group consisting of a discontinuous axle including a ball joint, a universal joint and a continuous flexible axle.

According to further features in preferred embodiments of the invention described below, the massage device comprising a shaft housing engaging a main rotating shaft, the shaft housing being formed suitable to grip by a user; and (b) a massage head being engaged by the shaft housing, the massage head including (i) a transmission means housing engaging a base, the base being connected to or integrally formed with the main rotating shaft, rotating therewith, the base having an inner side facing the transmission means housing and an outer side; (ii) at least one massage element, each of the at least one massage elements including an extended arm, each of the arms being peripherally hingedly connected to the base at one end and being supplemented with a skin engaging member at the other end; and (iii) means for providing each of the at least one massage elements with an active reciprocal arc movement, the active reciprocal arc movement being substantially parallel to the shaft.

According to still further features in the described preferred embodiments the body and joints massage device comprising (a) a shaft housing engaging a main rotating shaft, the shaft housing being formed suitable to grip by a user; and (b) a massage head being engaged by the shaft housing, the massage head including (i) a transmission means housing engaging a base, the base being connected or to or integrally formed with the main rotating shaft, rotating therewith; (ii) at least one massage element, each of the at least one massage elements being peripherally connected to the base rotating therewith, via a hinge, each of the at least one massage elements having an extended arm, the extended arm being supplemented with a cam engaging element on one side and with a skin engaging member on the other side; and (iii) cam means being fixedly attached or integrally formed within the transmission means housing, the cam engaging element being biased against the cam means via a biasing mechanism for providing each of the at least one massage elements with an active reciprocal arc movement, depending on the cam's structure.

According to still further features in the described preferred embodiments the cam means is substantially vertical.

According to still further features in the described preferred embodiments the engagement of the massage head by the shaft is effected by a quick release mechanism.

According to still further features in the described preferred embodiments the massage device further comprising a locking mechanism for optionally locking the shaft housing with the transmission means housing, thereby the transmission means housing is still while the base rotates.

According to still further features in the described preferred embodiments provided is a joints massage device comprising (a) a shaft housing engaging a main rotating shaft, the shaft housing being formed suitable to grip by a user; and (b) a massage head being engaged by the shaft, rotating therewith, the massage head including at least one massage element, each of the at least one massage elements being peripherally connected to the head via a hinge, and rotating therewith, each of the at least one massage elements having an extended arm, the extended arm being supplemented with a skin engaging member, the skin engaging members being positioned such that a space is formed therebetween, the space being dimensioned suitable for accommodating a massaged body joint.

According to still further features in the described preferred embodiments the engagement of the massage head by the shaft is effected by a quick release mechanism.

According to still further features in the described preferred embodiments provided is a method of massaging a body joint comprising the steps of (a) surrounding the body joint with massage elements supplemented with skin engaging members, the massage elements being connected to a rotation mechanism and forming a space therebetween, the space being for closely accommodating the body joint; and (b) operating the rotating mechanism, such that the skin engaging members rotate around the body joint and such that a contact is formed between the rotating skin engaging members and the body joint, thereby the body joint being massaged.

According to still further features in the described preferred embodiments the skin engaging members further perform a passive arc movement, while rotating and while contacting the body joint, resulting in a stronger rubbing effect.

The present invention successfully addresses the shortcomings of the presently known configurations by providing a body and joints massage device having changeable operating massage heads to obtain selected stroking, rubbing and/or kneading massaging effects of all body parts including body joints.

BRIEF DESCRIPTION OF THE DRAWINGS

The invention herein described, by way of example only, with reference to the accompanying drawings, wherein:

FIGS. 6*a* and 6*b* are a view from below and a cross section view, respectively, of yet another embodiments of the configuration of FIGS. 5*b* and 5*a*, respectively;

FIG. 7 is a cross section presentation of one embodiment of a biassing mechanism implemented in the body and joints massage device of FIGS. 5–6;

FIG. 8 is a cross section presentation of another embodiment of a biassing mechanism implemented in the body and joints massage device of FIGS. 5–6;

DESCRIPTION OF THE PREFERRED EMBODIMENTS

The present invention is of a hand held, electrically operated body and joints massage device having changeable massage heads which can be used to provide selected stroking, rubbing and/or kneading massaging effects. Specifically, the present invention can be used to massage all body parts including body joints such as heels, elbows, knees and shoulders.

The principles and operation of a body and joints massage device according to the present invention may be better understood with reference to the drawings and accompanying descriptions.

Figure 1:
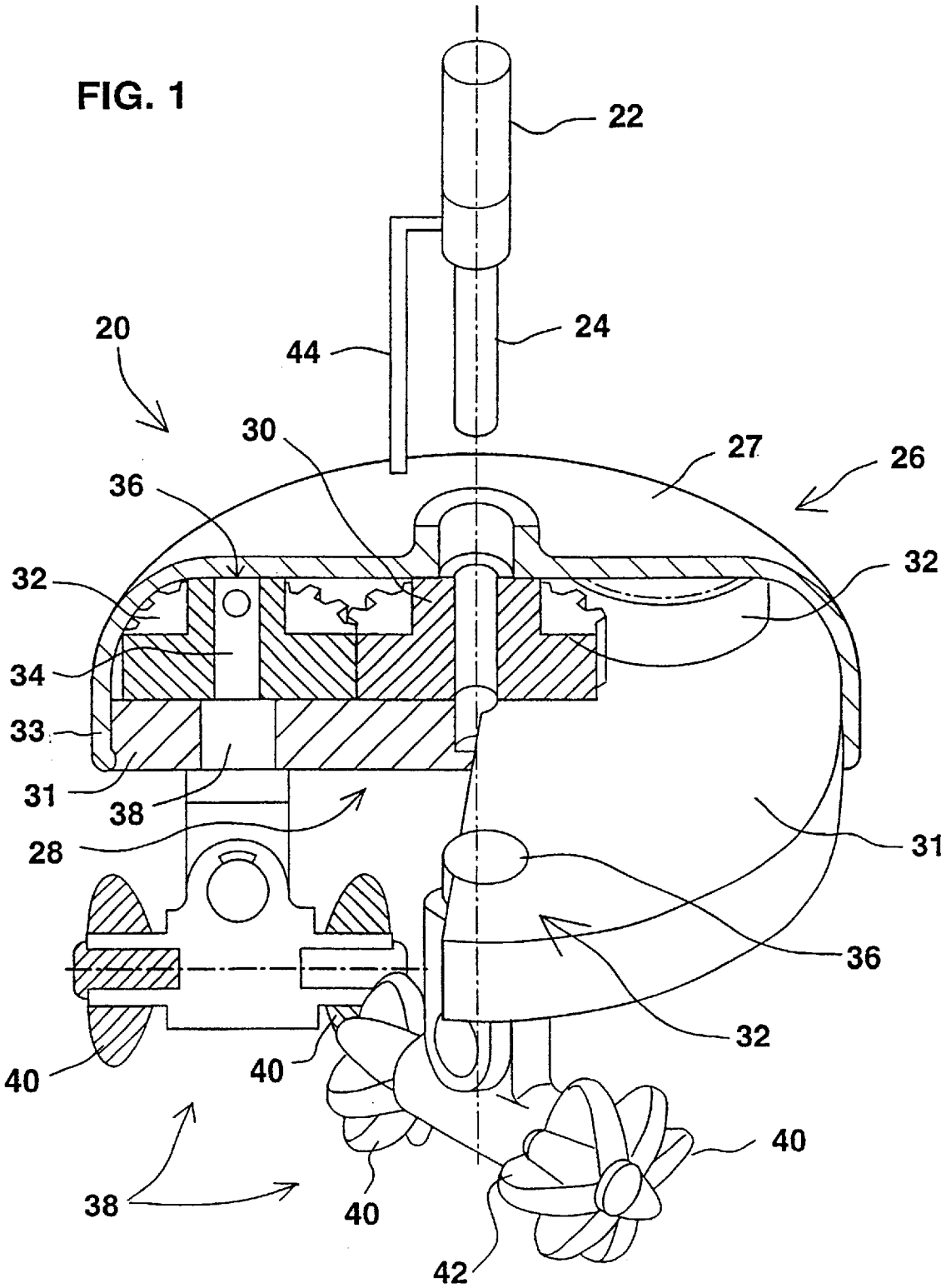
FIG. 1 is a cut through perspective view of one configuration of the body massage device of the present invention aimed at providing body stroking and rubbing massaging effects.

Referring now to the drawings, FIGS. 1 illustrates one preferred configuration of the body massage device of the present invention suitable of generating stroking and rubbing massaging effects. The body massage device presented in FIG. 1, referred to herein as device 20, includes a shaft housing 22 engaging a main rotating shaft 24, shaft housing 22 being formed suitable to grip by a user and serves as a handle of device 20. Preferably shaft housing 22 accommodates a motor (not shown) to rotate shaft 24, and a power supply such as a battery (not shown). It will be apparent to one ordinarily skilled in the art that the motor may be engaged elsewhere within device 20 and it is alse clear that instead of a self contained power supply, massage device 20 may be electrically operated by an external power source such as the electricity net. An operating switch (not shown) is also preferably positioned in housing 20. As mentioned, housing 20 is formed suitable to grip by a user. This is achieved for example by creating housing 20 having a rough surface to avoid its slippage from the hand of its operator. Other features of housing 20 making it suitable to grip by a user may include finger matching curves (not shown), like those formed in joy-sticks, as well known in the art.

Massage device 20 further includes a massage head 26. Massage head 26 includes a transmission means housing 27 engaging a rotational movement transmission mechanism 28. Housing 27 is preferably fabricated from a base 31 and a cover 33 to enable easy assembly of massage head 26. Rotational movement transmission mechanism 28 includes a central transmission center, shown in FIG. 1 in the form of gear 30. Central transmission center 30 is connected to or integrally formed with main shaft 24 and rotates therewith. It is clear to one ordinarily skilled in the art that central transmission center 30 may alternatively be in the form of belt transmission (not shown). Rotational movement transmission mechanism 28 further includes at least one, preferably two, more preferably three or more peripheral transmission centers, shown in FIG. 1 in the form of gears 32 arranged in the periphery of central transmission center 30, which peripheral gears 32 are rotated by being in direct or indirect (i.e., additional gear or belt transmission means) connection with central transmission center 30. It is, however, clear that peripheral transmission centers may alternatively be in the form of belt transmission (not shown). Each of peripheral transmission centers 32 is connected to an axis 34, axes 34 are rotatably accommodated in fixed locations 36 formed in base 31 of housing 27.

Massage head 26 further incudes at least one massage element 38, each of massage elements 38 is connected to one of the peripheral transmission centers 32, rotating therewith. In the configuration shown in FIG. 1, massage elements 38 are constructed protruding from base 31 of housing 27, each having at least one, preferably two (as shown in FIG. 1), or more, passively rotating rollers 40. As further shown, rollers 40 may be formed having recessions 42 to increase their massaging effect. For some applications rollers 40 may be replaced by other spherical members such as balls, etc. Rollers 40 belonging to a specific massage element 38 may either independently rotate or alternatively rotate synchronously to generate different massaging effects. In a preferred embodiment, rollers 40 are capable of moving about (i.e., rocking) rendering them more suitable to accommodate skin curvatures associated with massaging.

Preferably, device 20 further includes a quick release mechanism (not shown), enabling a quick connection/disconnection of massage head 26 and shaft housing 22. As described in more details hereinbelow, such a quick release mechanism is for enabling easy changing of massage heads connected to shaft housing 22.

Massage device 20 has two operation modes as follows. According to the first operation mode of device 20, a user grips housing 22 and operates device 20. As a result, shaft 24 rotates relative to housing 22 and transmission center 30 rotates therewith. As a result of the rotation of transmission center 30 (i) each of peripheral transmission centers 32 rotates around its corresponding axis 34 and massage elements 38 rotate therewith; and (ii) due to the peripheral location of peripheral transmission centers 32 and their connection via axes 34 to fixed locations 36 at housing 27, housing 27 itself rotates. Thus each of massage elements 38 performs a superimposed active movement of rotating around a central point (a type I movement, as defined in the background section above) and around its longitudinal axis (a type II movement).

According to the second operation mode of device 20, a user grips housing 27 and operates device 20. As a result the rotational movement of housing 27 is ceased while the rotation of peripheral transmission centers 32 and massage elements 38 continues, thus only type II movement is exercised.

It will be appreciated that whenever type II movement is actuated and massage elements 38 are contacted with the skin of a massaged body part, a passive rotational movement of rollers 40 is actuated due to friction formed between the skin and rollers 40, deepening the massaging effect of device 20.

In a preferred embodiment device 20 further includes a locking mechanism 44 for optionally locking shaft housing 22 with transmission means housing 27. When operated, locking mechanism 44 locks housing 27 to housing 22. As a result, rotational movements identical to those described above for the second operation mode are obtained while the user grips housing 22 (preferably formed as a handle) instead of housing 27 which in nature is less convenient to grip.

In all cases, the direction (i.e., right or left rotation) and speed in which shaft 24 rotates is preferably selectable, for example by the operating switch.

Figure 2:
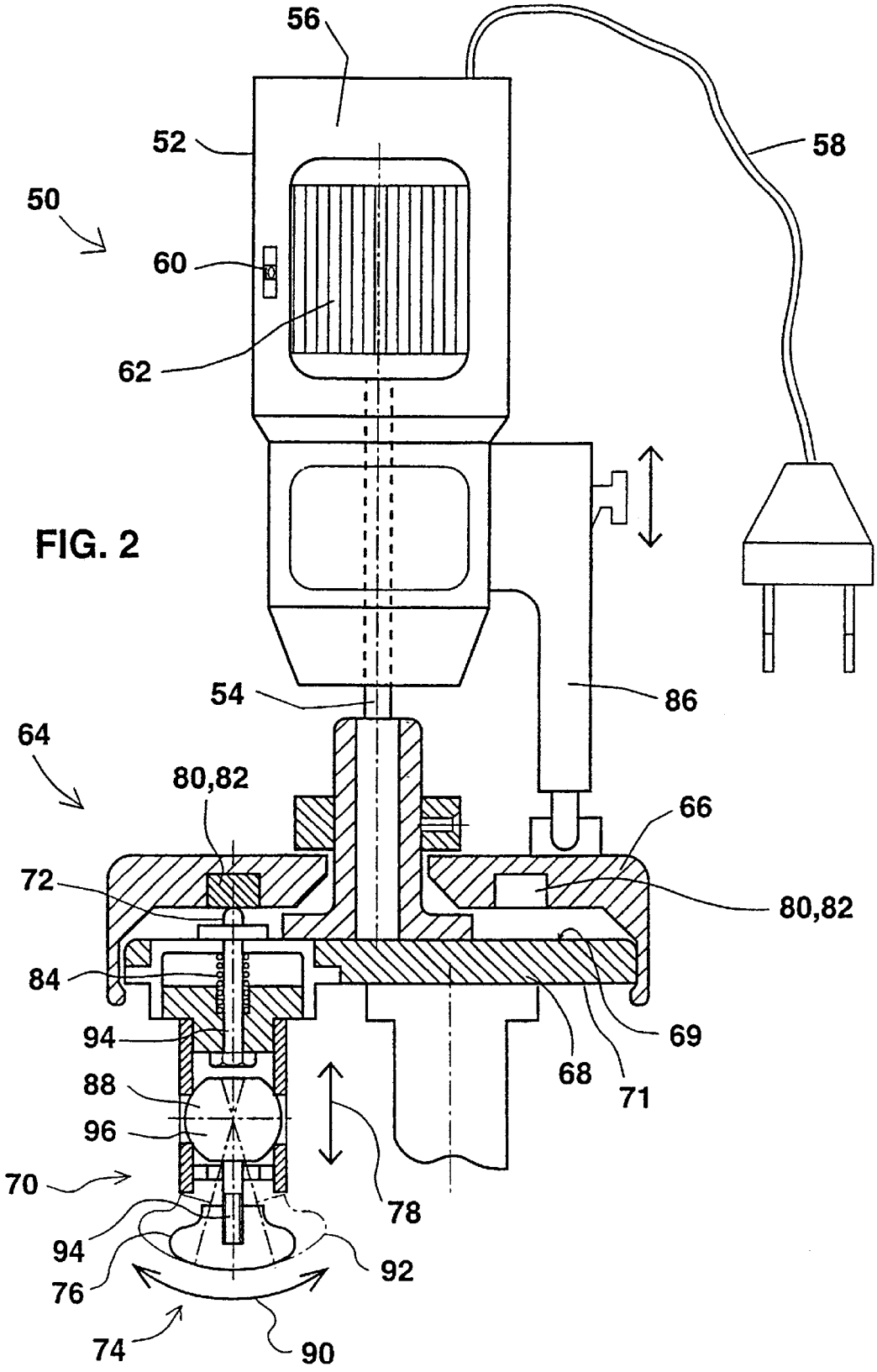
FIG. 2 is a cross section view through another configuration of the body massage device of the present invention aimed at providing mild and deep body kneading massaging effect.
Figure 3A:
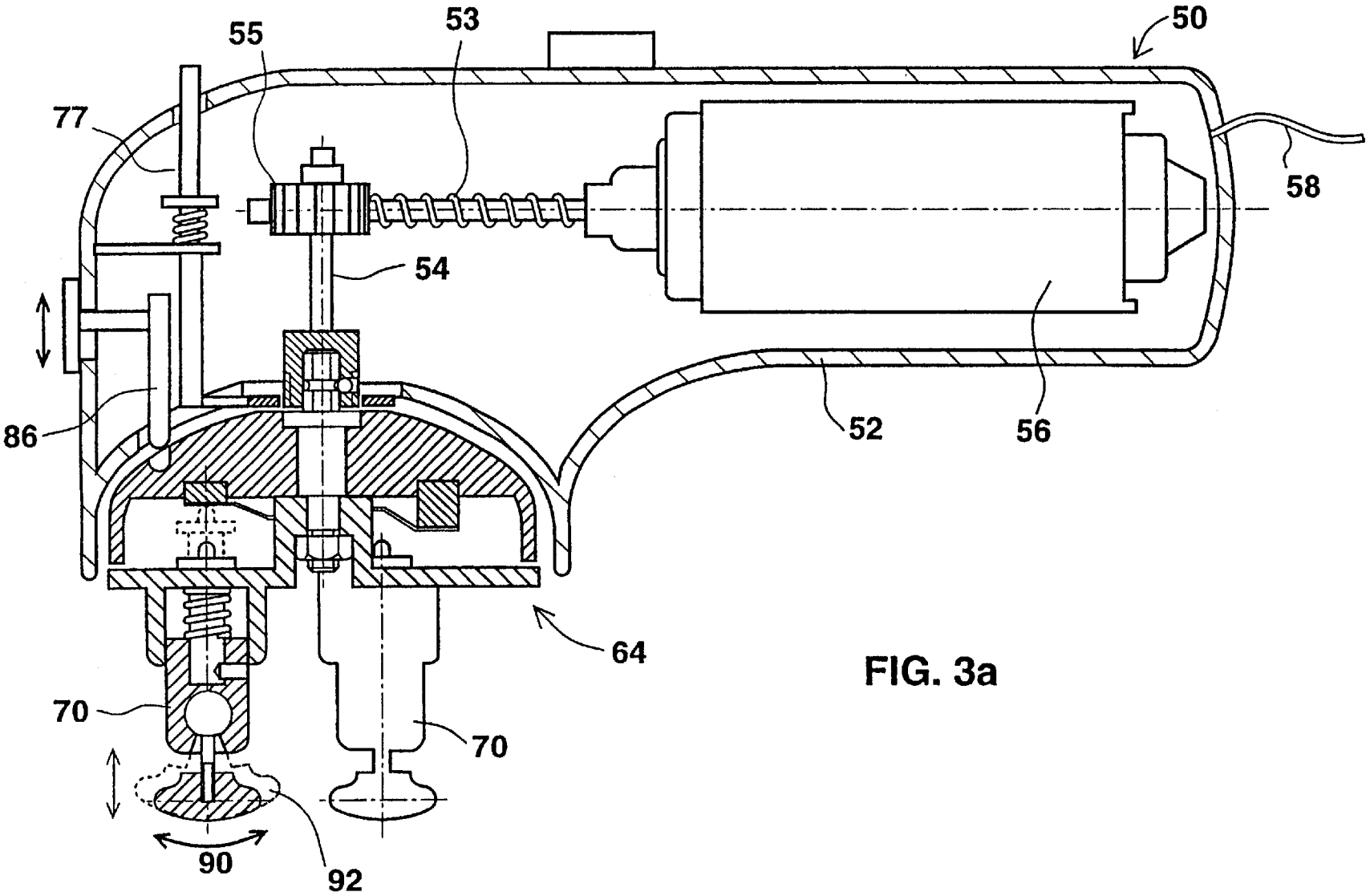
FIGS. 3*a* and 3*b* are cross section views of different embodiments of the configuration of the body massage device of FIG. 2.
Figure 3B:
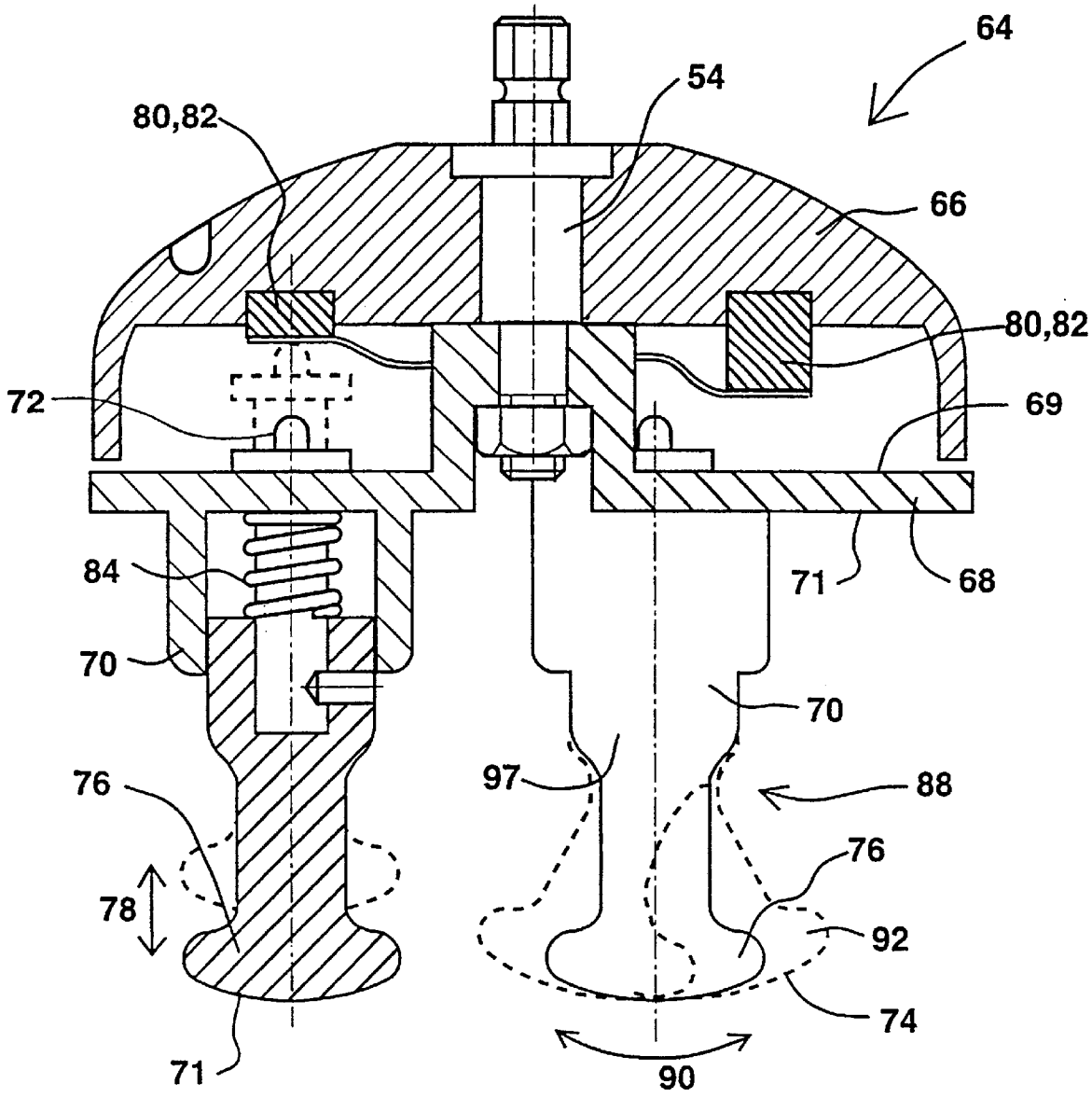

With reference now to FIGS. 2 and 3*a–b*, presented is a second preferred configuration of the body massage device of the present invention suitable of generating mild and deep kneading massaging effects. Similar to device 20, the body massage device presented in FIGS. 2 and 3*a–b*, referred to herein as device 50, includes a shaft housing 52 engaging a main rotating shaft 54, shaft housing 52 being formed suitable to grip by a user. As for device 20, shaft housing 52 preferably further includes a motor 56 to rotate shaft 54, and a connection to power supply 58. Shaft housing 52 may alternatively or additionally include a self contained power supply such as a battery (not shown). It will be apparent to one ordinarily skilled in the art that motor 56 may be engaged elsewhere. An operating switch 60 is also preferably positioned in housing 50. As mentioned, housing 52 is formed suitable to grip by a user. This may be achieved, as described above for device 20, by, for example, creating housing 50 having a rough surface 62 to avoid its slippage from the hand of its operator. Other features of housing 52 making it suitable to grip by a user may include finger matching curves (not shown) as well known in the art and as, to a limited extent, described above.

Massage device 50 further includes a massage head 64. Massage head 64 includes a transmission means housing 66 engaging a base 68 which is connected to or integrally formed with main rotating shaft 54, rotating therewith (a type I movement as defined in the background section above). Base 68 has an inner side 69 facing transmission means housing 66 and an outer side 71.

As shown in FIG. 2, shaft housing 52 may be deployed colinearly with shaft 54. Alternatively, as shown in FIG. 3*a*, shaft housing 52 may be deployed angularly (e.g., 90°) relative to shaft 54. In the later case, motor 56 indirectly rotates shaft 54 via an additional shaft 53 and angular transmission means 55.

Massage head 64 further includes at least one, preferably two, more preferably three or more, massage elements 70, each of massage elements 70 is peripherally and movably connected to base 68. Each of massage elements 70 has a first end 72 protruding from inner side 69 of base 68 towards transmission means housing 66, and a second end 74 protruding from outer side 71 of base 68. Second end 74 is engaged by a skin engaging member 76. Massage head 64 further includes first means 80 for providing each of massage elements 70 with an active reciprocal linear movement (a type III movement as defined in the background section above). As indicated in FIGS. 2 and 3*a* by arrow 78, the active reciprocal linear movement is substantially parallel to shaft 54.

First means 80 includes a cam 82 engaged in transmission means housing 66, cam 82 has a reciprocal structure (e.g., sinusoidal structure, etc.) protruding/partly-protruding as shown in FIG. 3*b* or, as shown in FIG. 2, recessing/partly-recessing from transmission means housing 66 towards base 68. According to one embodiment best seen in FIG. 2, first end 72 of each of massage elements 70 is biased against cam 82. Thus biasing first end 72 of each of massage elements 70 against cam 82 is by biasing means 84 (a spring 84 in the example of FIG. 2). According to another and preferred embodiment, as best seen in FIG. 3*b*, biasing means 84 is for keeping first end 72 of each of massage elements 70 away from cam 82 when elements 70 are not in contact with the skin of a user. When, on the other hand, elements 70 are contacted with the skin of the user, elements 70 are pressed against biassing means 84, ends 72 are contacted with cam 82 and the active reciprocal linear movement described above is obtained when cam 82 rotates relative to ends 72.

Massage device 50 further includes a locking mechanism 86 for optionally locking shaft housing 52 to transmission means housing 66, rendering transmission means housing 66 still, while base 68 rotates.

Massage head 64 further includes second means 88. Means 88 is for providing each of massage elements 70 with a passive flexible conical random movement, the passive flexible conical random movement, as indicated by arrow 90 and 'shadow' 92, is substantially orthogonal in its general direction to the active reciprocal linear movement indicated by arrow 78. Second means 88 may include, but is not limited to, mechanisms such as a discontinuous axle 94 best seen in FIG. 2, including a ball joint 96 or, alternatively, a universal joint (not shown) or a continuous flexible axle 97 best seen in FIG. 3*b*, made of an elastic material. It should be noted that when the term 'flexible axle' is used herein and in the claims it also refers to an axle having flexible part or parts.

According to another embodiment second means 88 includes a mechanism implemented in main rotating shaft 54, rendering it flexible. This mechanism may be in any of the forms described above for each of massage elements 70, such as, for example, a discontinuous axle including a ball joint, a universal joint and a continuous flexible axle.

Similar to massage device 20, massage device 50 also has two operation modes as follows.

According to the first operation mode of device 50, a user grips housing 52 and operates device 50. As a result, shaft 54 rotates relative to housing 52 and base 68, and massage elements 70 rotates therewith, performing a type I movement. In the first operation mode of body massage device 50, locking mechanism 86 is unlocked, therefore housing 66 rotates parallel to base 68. As a result of the parallel rotation of housing 66, no relative movement occurs between cam 82 and first ends 72 of massage elements 70, therefore, according to the first operation mode of body massage device 50, first means 80 for providing each of massage elements 70 with an active reciprocal linear movement (type III movement) is inoperative. Thus, according to the first operation mode of device 50, each of massage elements 70 performs a rotational movement combined with the movement imposed by the flexible construction (i.e., as imposed by second means 88) of massage elements 70. Thus, the first operation mode of body massage device 50, offers a mild kneading massaging effect.

According to the second operation mode of device 50, a user grips housing 52 and operates device 50. As a result, shaft 54 rotates relative to housing 52 and base 68, and massage elements 70 rotates therewith, performing a type I movement. In the second operation mode of body massage device 50, locking mechanism 86 is locked, therefore housing 66 does not rotate at all. As a result of housing 66 being still, a relative movement occurs between cam 82 and first ends 72 of massage elements 70, therefore, according to the second operation mode of body massage device 50, first means 80 is providing each of massage elements 70 with an active reciprocal linear movement (type III movement). Thus, according to the second operation mode of device 50, each of massage elements 70 performs a rotational type I movement superimposed with a linear reciprocal type III and with the passive flexible conical random movement imposed by the flexible construction (i.e., second means 88) of massage element 70. Thus, the second operation mode of body massage device 50, offers a deep kneading massaging effect.

In all cases, the direction (i.e., right or left rotation) and speed in which shaft 54 rotates is preferably selectable by switch 60.

As further shown in FIG. 3*a*, device 50 further includes a quick release mechanism 77, enabling a quick connection/disconnection of massage head 64 and shaft housing 52. Such a quick release mechanism is deployed to enable easy changing of massage heads connected to the shaft housing.

Figure 4A:
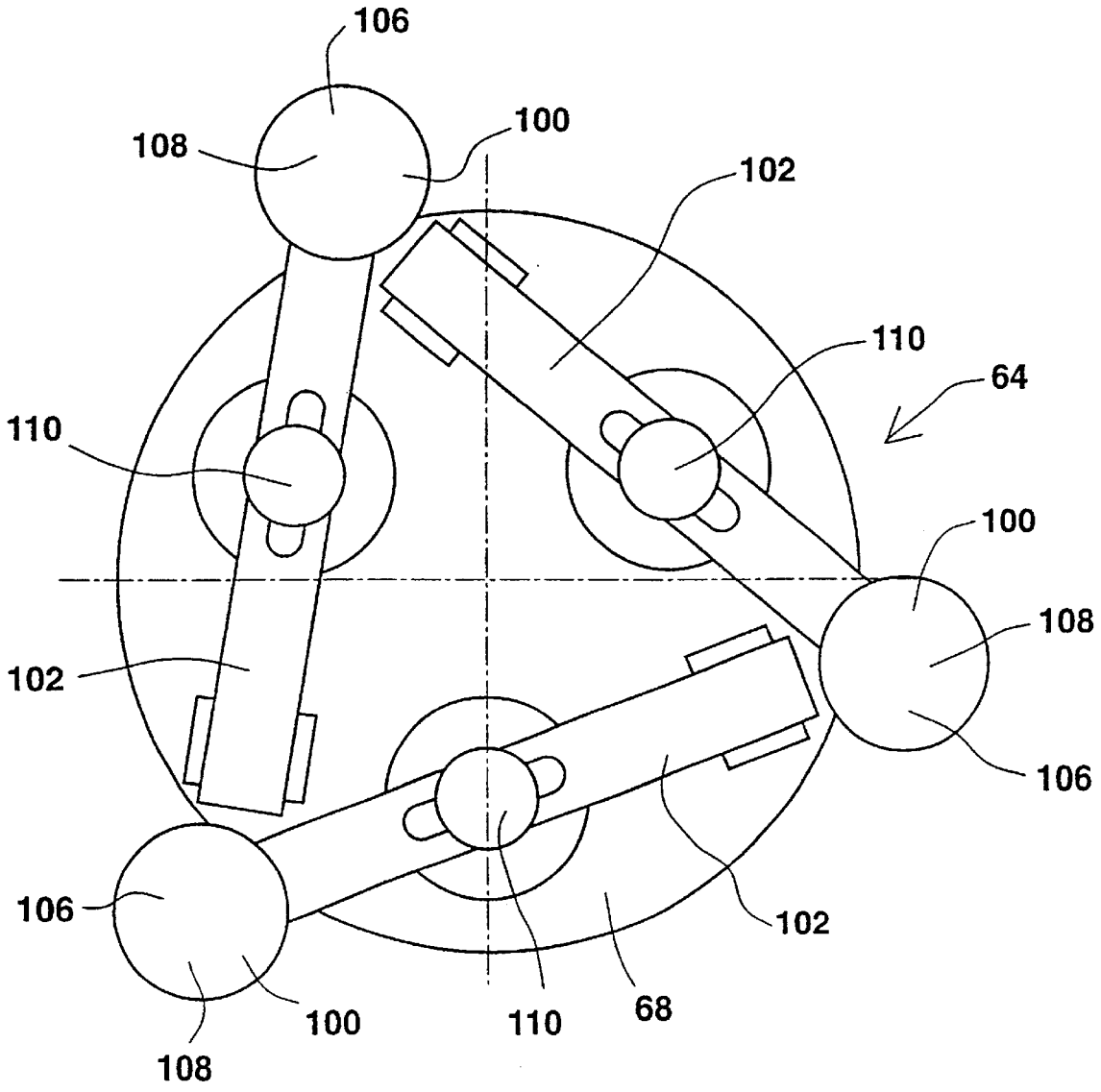
FIGS. 4*a* and 4*b* are a view from below and a cross section view, respectively, of another embodiment of the configuration of a body massage device as presented in FIG. 2, this embodiment is suitable for both body and joints massage.
Figure 4B:
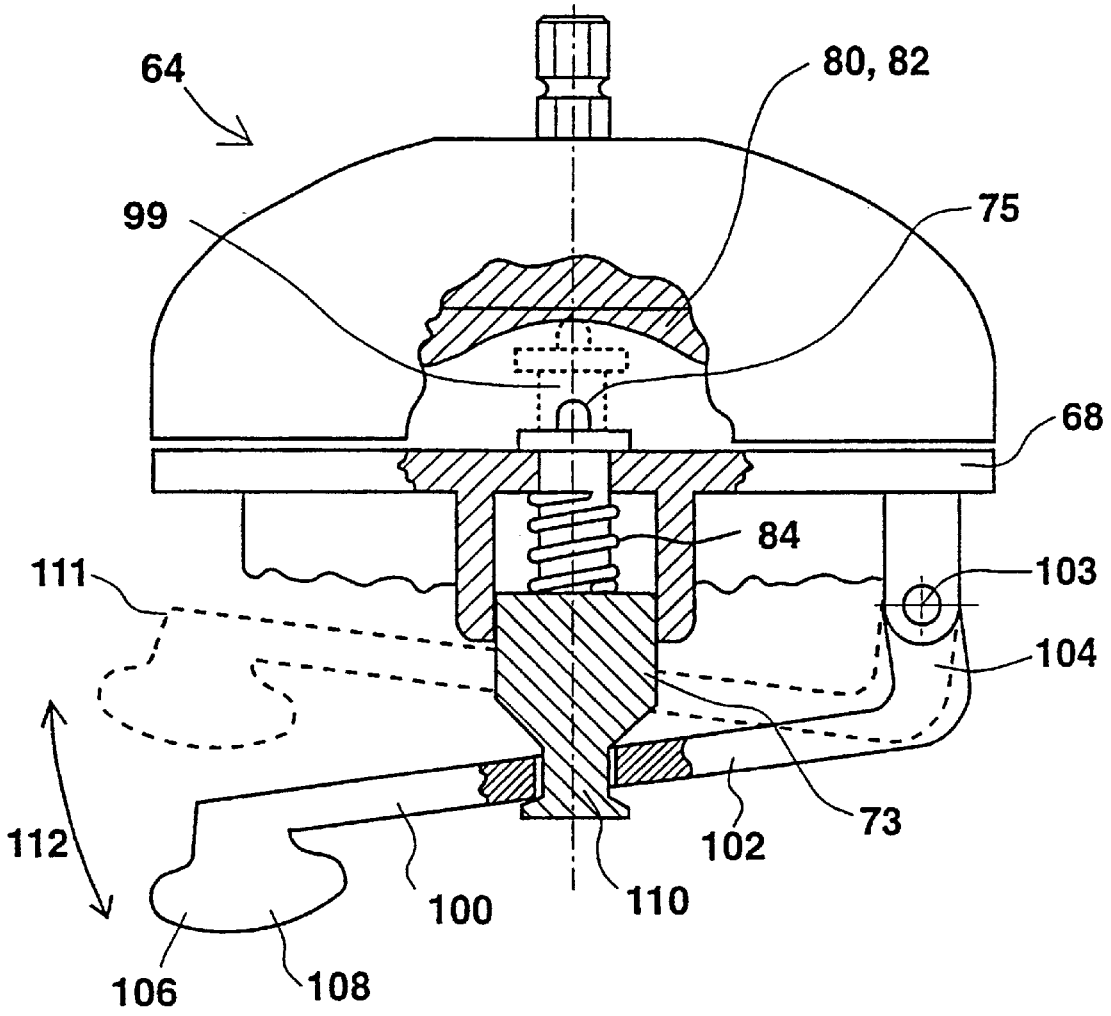

According to another embodiment of the second configuration, as presented in FIGS. 4*a–b*, massage head 64 of device 50 includes at least one, preferably two, more preferably three or more, massage elements 100, replacing massage elements 70. Each of massage elements 100 includes an extended arm 102 which is hingedly connected to base 68 via an axis 103 at one end 104, whereas to its other end 106 connected to or integrally formed with is a skin engaging member 108. At a point 110 along its length, each extended arm 102 is operated similarly to massage elements 70 via first means 80 providing an active reciprocal linear movement which, in turn, provides massage elements 100 with an active reciprocal arc movement, indicated in FIG. 4*b* by arrow 112 and shaded arm 111. Similar to as described before, biasing means 84 is keeping ends 75 of arm connectors 73 away from cam 82 when elements 100 are not in contact with the skin of a user. When, on the other hand, elements 100 are contacted with the skin of the user, elements 100 are, as indicated in FIG. 4*b* by shaded form 99, pressed against biassing means 84, ends 75 are contacted with cam 82 and the active reciprocal arc movement described above is obtained when cam 82 rotates relative to ends 75.

In one embodiment extended arms 102 are fabricated from an elastic material rendering them flexible, yet in a preferred embodiment the flexibility of arms 102 is selected low, rendering them more suitable for a deep massaging effect.

Thus constructing massage elements 100 renders massage head 64 highly suitable both for a close contact body and for joints massage, wherein a massaged joint (e.g., a heel) is situated amongst skin engaging members 108.

With reference now to FIGS. 5*a–b*, 6*a–b*, 7 and 8, presented is a third preferred configuration of the body massage device of the present invention, which is suitable of generating mild and deep kneading body and/or rubbing joints massaging effects. Similar to devices 20 and 50, the body massage device presented in FIGS. 5–8, which is referred to herein as device 150, includes a shaft housing 152 engaging a main rotating shaft 154. Shaft housing 152 is formed suitable to grip by a user. Preferably, shaft housing 152 further includes a motor to rotate shaft 154 and a connection to a power supply. It will be apparent to one ordinarily skilled in the art that housing 152 may have additional features such as those described hereinabove with respect to housings 22 and 52.

Massage device 150 further includes a massage head 164. Massage head 164 includes a transmission means housing 166 engaging a base 168 which is connected to or integrally formed with main rotating shaft 154, rotating therewith (a type I movement as defined in the background section above). Housing 166 further engages a cam means 167 having a reciprocal structure (e.g., sinusoidal structure, etc.). Cam means 167 may be internally fixedly attached to or integrally formed with housing 166.

Figure 5A:
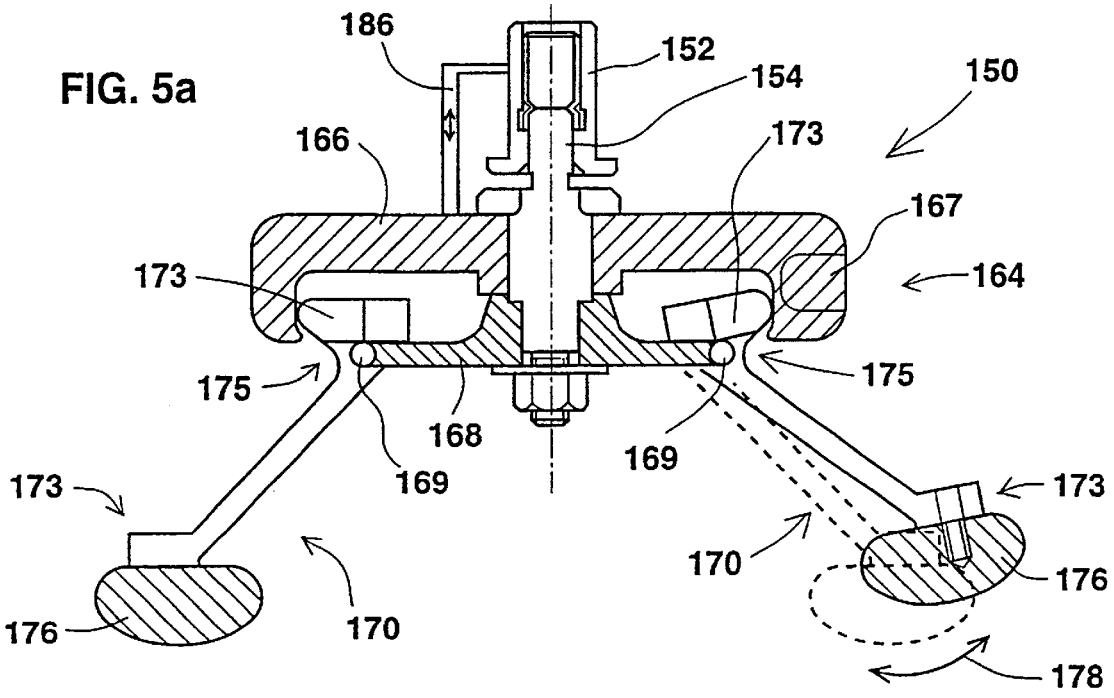
FIGS. 5*a* and 5*b* are a cross section view and a view from below, respectively, of yet another configuration of a body and joints massage device according to the present invention.
Figure 5B:
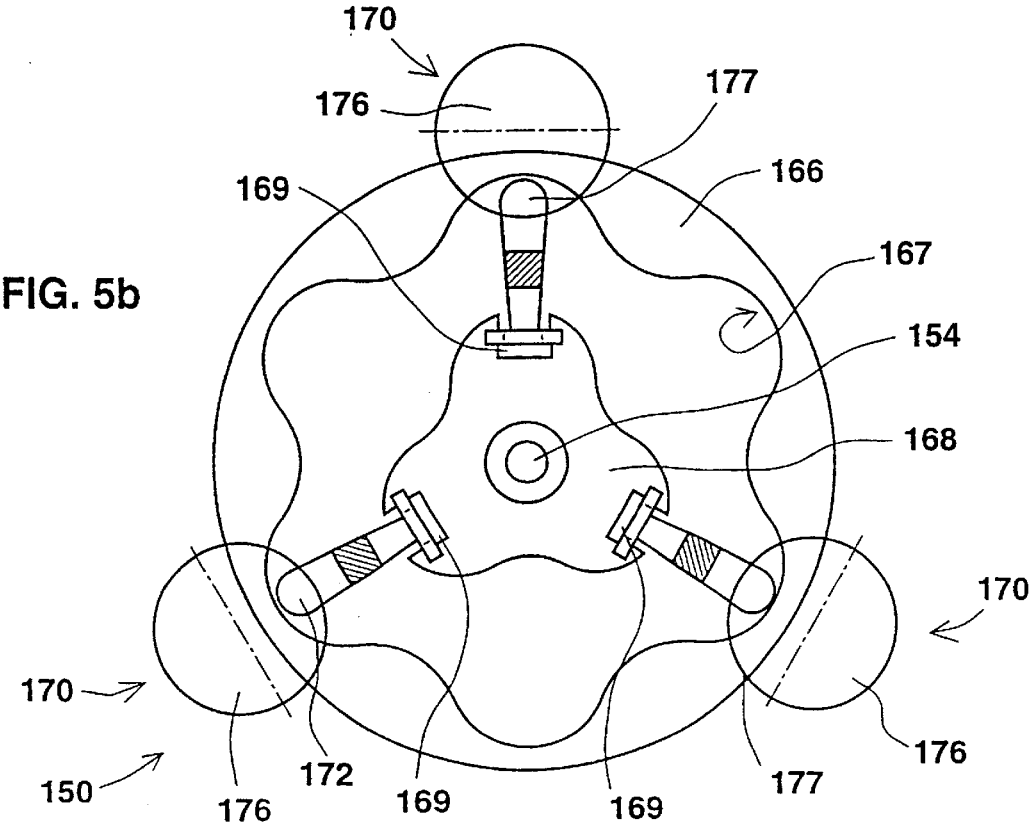

Massage head 164 further includes at least one, preferably two, more preferably three or more, most preferably six or more, massage elements 170. Each of massage elements 170 includes an extended arm 171, which is hingedly connected to base 168 via a hinge 169 at one end 175, whereas to its other end 173 connected to or integrally formed with is a skin engaging member 176. At end 175, each of extended arms 171 includes a cam engaging member 177, which is biased against cam 167 aided by a biasing mechanism 179. As shown in FIGS. 6*b*, 7 and 8, biasing mechanism 179 may acquire various forms and may pull (as shown in FIG. 7) or push (as shown in FIGS. 6*b* and 8) member 177 against cam 167. Cam 167, hinge 169 biassing mechanism 179 and cam engaging member 177 provide each of massage elements 170 with an active reciprocal arc movement as indicated in FIGS. 5*a* and 6*b* by arrow 178 and shaded arms 190.

In preferred embodiments and as exemplified in FIGS. 5–8, cam means 167 is selected vertical or substantially vertical (either externally or internally oriented relative to cam engaging member 177). Nevertheless, as will be appreciated by one ordinarily skilled in the art, cam means 167 may alternatively be horizontal or in any angular orientation and may be implemented above or below cam engaging members 177.

In one embodiment of the invention extended arms 171 are fabricated from an elastic material rendering them flexible, yet in a preferred embodiment, the flexibility of arms 171 is selected low, rendering them more suitable for deep massaging effects. Thus constructing massage elements 170 renders massage head 164 highly suitable both for a close contact body massage and for joints massage, wherein a massaged joint (e.g., a heel) is situated amongst skin engaging members 176.

Preferably, massage device 150 further includes a locking mechanism 186 for optionally locking shaft housing 152 with transmission means housing 166, rendering transmission means housing 166 still while base 168 rotates.

Preferably, device 150 further includes a quick release mechanism similar to quick release mechanism 77 of device 50 for enabling a quick connection/disconnection of massage head 164 and shaft housing 152. As described above, such a quick release mechanism is for enabling easy changing of massage heads connected to shaft housing 152.

Similar to massage devices 20 and 50, massage device 150 also has two operation modes as follows.

According to the first operation mode of device 150, a user grips housing 152 and operates device 150. As a result, shaft 154 rotates relative to housing 152 and base 168 and massage elements 170 rotate therewith performing a type I movement as defined above. In the first operation mode of body massage device 150, locking mechanism 186 is unlocked, therefore housing 166 rotates parallel to base 168. As a result of the parallel rotation of housing 166, no relative movement occurs between cam 167 and cam engaging members 177 of massage elements 170, therefore, according to the first operation mode of body massage device 150, cam 167 providing each of massage elements 170 with an active reciprocal arc movement is inoperative. Thus, according to the first operation mode of device 150 each of massage elements 170 perform a rotational movement (a type I movement). Thus, the first operation mode of body massage device 150, offers a mild kneading massaging effect and joints massage.

According to the second operation mode of device 150, a user grips housing 152 and operates device 150. As a result shaft 154 rotates relative to housing 152 and base 168 and massage elements 170 rotate therewith performing a type I movement. In the second operation mode of body massage device 150, locking mechanism 186 is locked, therefore housing 166 does not rotate at all. As a result of housing 166 being still, a relative movement occurs between cam 167 and cam engaging member 177 of massage elements 170, therefore, according to the second operation mode of body massage device 150, cam 167 is providing each of massage elements 170 with an active reciprocal arc movement. Thus, according to the second operation mode of device 150, each of massage elements 170 performs a rotational type I movement superimposed with a linear reciprocal arc movement. Thus, the second operation mode of body massage device 150, offers a deep kneading massaging effect of various body parts.

Figure 9A:
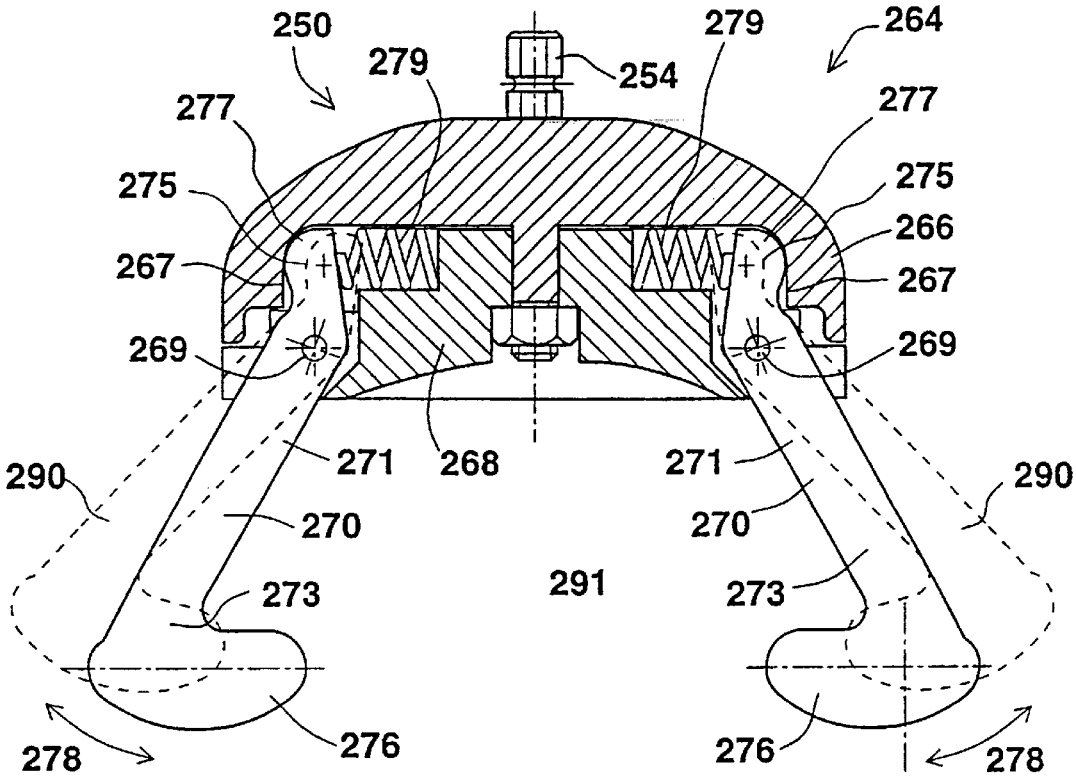
FIGS. 9*a* and 9*b* are a cross section view and a view from below, respectively, of still another configuration of a body and joints massage device according to the present invention.
Figure 9B:
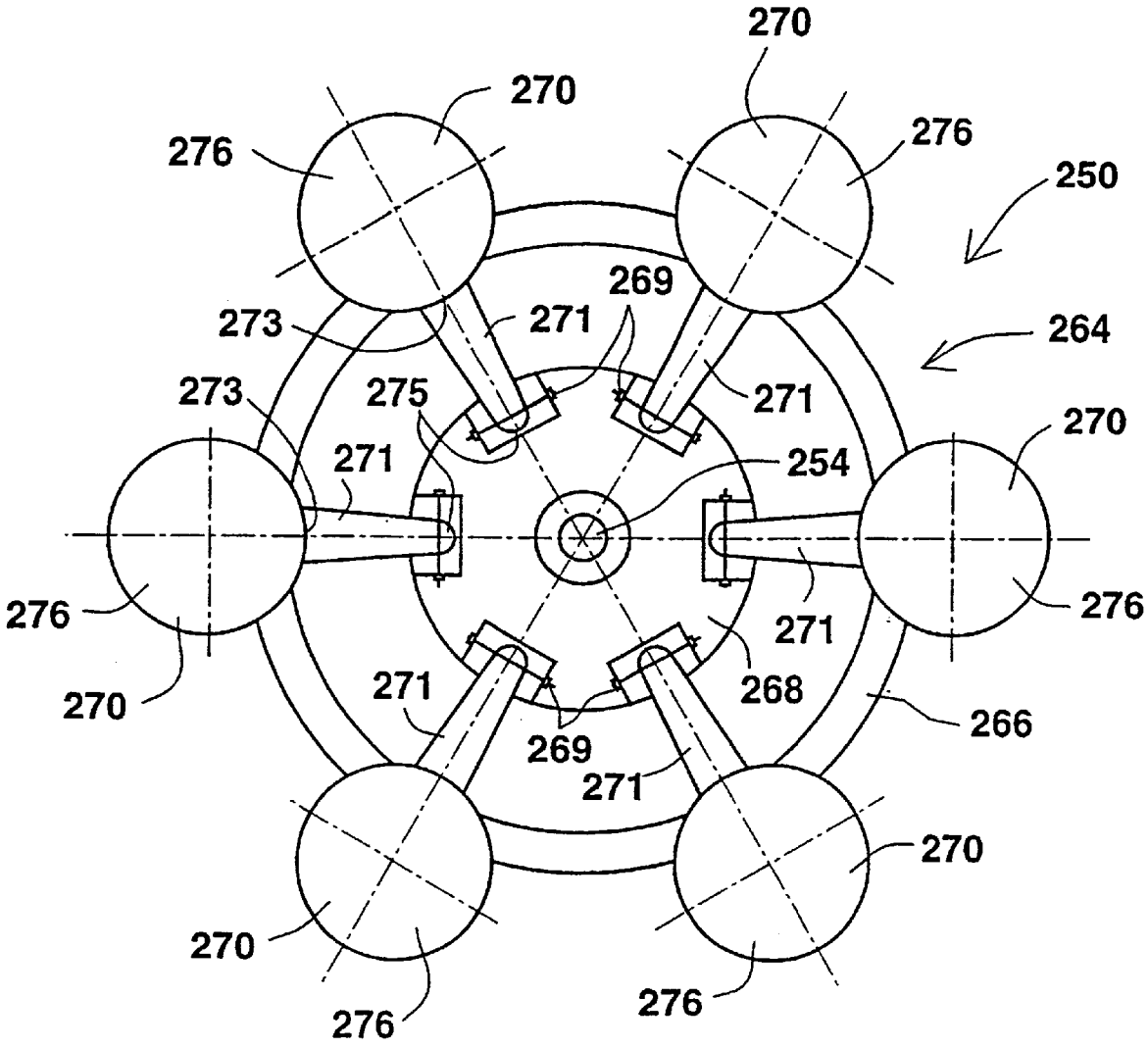

With reference now to FIGS. 9*a–b*, presented is a fourth preferred configuration of the body massage device of the present invention, which is suitable of generating a cross friction massage of body joints. Similar to devices 20, 50 and 150, the body massage device presented in FIGS. 9*a–b*, which is referred to herein as device 250, includes a shaft housing (similar, for example, to housing 152 of FIG. 5*a*) engaging a main rotating shaft 254. The shaft housing is formed suitable to grip by a user. As described with respect to the above described embodiments of the invention, preferably, the shaft housing further includes a motor to rotate shaft 254 and a connection to a power supply. It will be apparent to one ordinarily skilled in the art that the shaft housing may have additional features such as those described hereinabove with respect to housings 22, 52, and 152.

Massage device 250 further includes a massage head 264. Massage head 264 includes a transmission means housing 266 engaging a base 268 which is connected to or integrally formed with main rotating shaft 254, rotating therewith (a type I movement as defined in the background section above). Housing 266 is formed with a substantially circular lip 267. Lip 267 may be internally fixedly attached to or integrally formed with housing 266.

Massage head 264 further includes at least one, preferably two, more preferably three or more, most preferably six or more, massage elements 270. Each of massage elements 270 includes an extended arm 271, which is hingedly connected to base 268 via a hinge 269 at one end 275, whereas to its other end 273 connected to or integrally formed with is a skin engaging member 276. As best seen in FIG. 9*a*, at end 275, each of extended arms 271 includes a lip engaging member 277, which is biased against lip 267 aided by a biasing mechanism 279. Similar to as shown in FIGS. 6*b*, 7 and 8, biasing mechanism 279 may acquire various forms and may pull or push member 277 against lip 267. Lip 267, hinge 269 biassing mechanism 279 and lip engaging member 277 allow each of massage elements 270 to perform a unidirectional passive reciprocal arc movement, as indicated in FIG. 9*a* by arrow 278 and shaded arms 290.

In preferred embodiments and as exemplified in FIGS. 9*a–b*, lip 267 is selected vertical or substantially vertical (either externally or internally oriented relative to lip engaging member 277). Nevertheless, as will be appreciated by one ordinarily skilled in the art, lip 267 may alternatively be horizontal or in any angular orientation and may be implemented above or below lip engaging members 277.

In one embodiment of the invention extended arms 271 are fabricated from an elastic material rendering them flexible, yet in a preferred embodiment, the flexibility of arms 271 is selected low, rendering them more suitable for stronger rubbing massage effects. Thus constructing massage elements 270 renders massage head 264 highly suitable for joints massage, wherein a massaged joint (e.g., a heel) is situated amongst skin engaging members 276. To this end, skin engaging members 276 are concentrically arranged and form a joint accepting space 291 therebetween, which space 291 is selected large enough to accommodate a body joint.

Preferably, device 250 further includes a quick release mechanism similar to quick release mechanism 77 of device 50 for enabling a quick connection/disconnection of massage head 264 and the shaft housing. As described above, such a quick release mechanism is for enabling easy changing of massage heads connected to the shaft housing.

The operation of massage device 250 is as follows. A user grips the shaft housing and operates device 250. As a result, shaft 254 rotates relative to the shaft housing and base 268, and massage elements 270 rotate therewith, performing a type I movement as defined above, and a passive arc movement when contacted with a massaged body joint.

Figure 10:
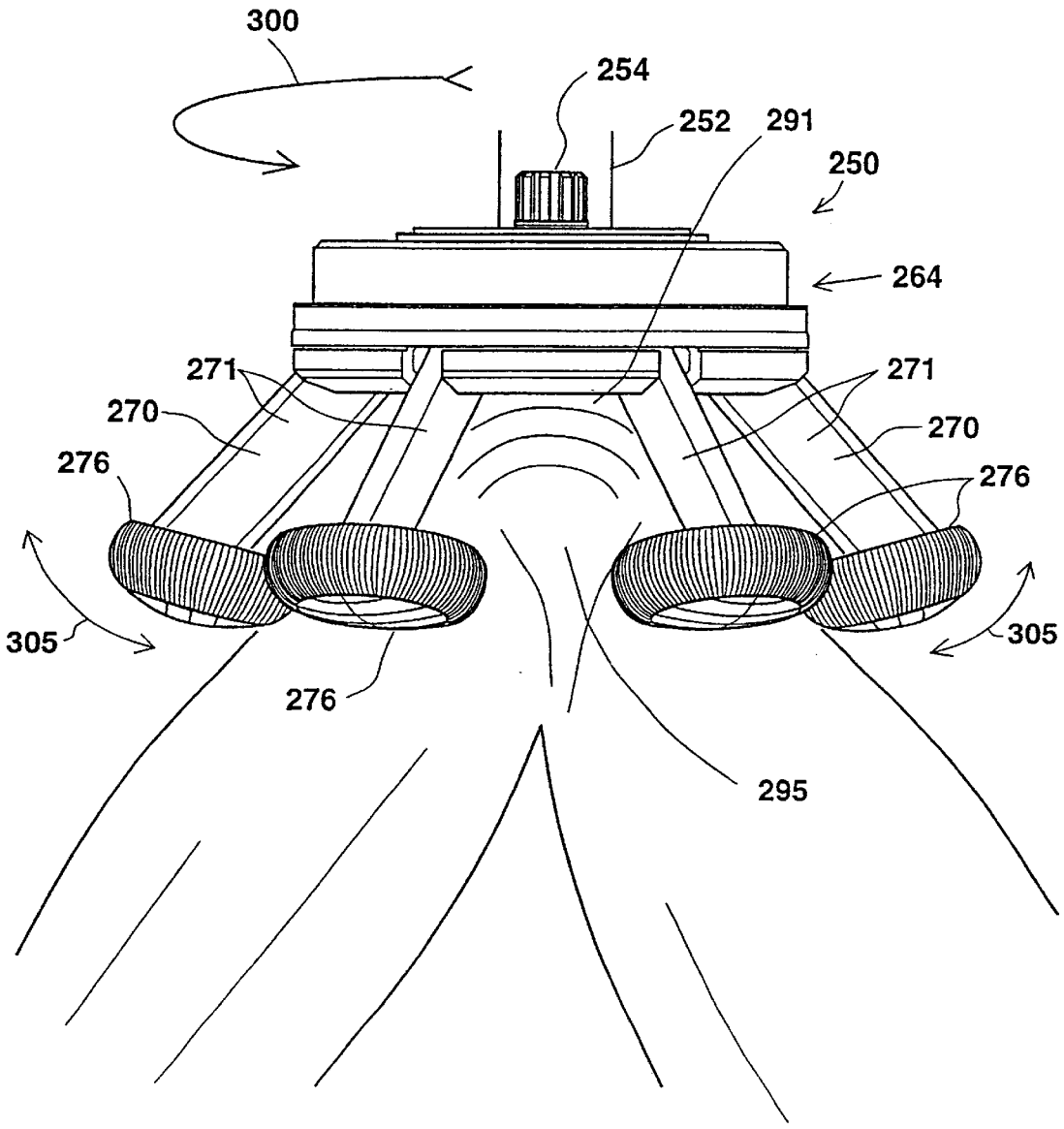
FIG. 10 is a perspective view of a minimal configuration of the device shown in FIGS. 9*a–b*, when used for a knee massage.

With reference now to FIG. 10, in a minimal configuration massage device 250 therefore includes a shaft housing 252 engaging a main rotating shaft 254, shaft housing 252 is formed suitable to grip by a user. According to its minimal configuration massage device 250 further includes a massage head 264 engaged by shaft 254, rotating therewith, the massage head includes at least one massage element 270, each of which is peripherally connected to head 264 via a hinge (internal), rotating therewith, each of which further having an extended arm 271, which is supplemented with a skin engaging member 276, which are positioned such that a space 291 is formed therebetween, wherein space 291 thus formed is dimensioned suitable for accommodating a massaged body joint 295, a knee in the example given in FIG. 10. In a preferred embodiment of the invention, the skin engaging members may both rotate, as indicated by arrow 300 and perform a passive arc movement while rotating and while contacting body joint 295, as indicated by arrows 305, resulting in a stronger rubbing massage effects of joint 295.

According to the present invention there is also provided a method of massaging a body joint. The method includes the steps of (a) surrounding the body joint with massage elements supplemented with skin engaging members, the massage elements are connected to a rotation mechanism (e.g., shaft 254 and head 264) and form a space therebetween suitable for closely accommodating the body joint; and (b) operating the rotation mechanism, such that the skin engaging members rotate around the body joint and such that a contact is formed between the rotating skin engaging members and the body joint, thereby the body joint being massaged. In a preferred embodiment of the method according to the present invention, the skin engaging members further perform a passive arc movement, while rotating and while contacting the body joint, resulting in a stronger rubbing effect.

Thus, the body and joints massage device of the present invention includes a shaft housing engaging a main rotating shaft, the shaft housing being formed suitable to grip by a user and may be engaged with different types of massage heads. Using a quick release mechanism and suitable construction of the massage heads and the shaft housing, the various heads may be easily connected to or disconnected from a single shaft housing (i.e., changeable heads). One type of head includes actively rotating and actively self rotating massage elements each is equipped with passively rotating rollers for body stroking and rubbing. Another type includes actively rotating, flekible and/or extended massage elements each also performs an active or passive reciprocal linear or arc movement for body and/or joints massage. Yet another type includes actively rotating extended massage elements, each also performs an active or passive reciprocal arc movement for body and joints massage.

In a preferred embodiment a single shaft housing is constructed operatively adjustable to the various types of massage heads described hereinabove.

Hence, the body and joints massage device of the present invention have advantages over the prior art devices described above in the background section by offering changeable operating massage heads to obtain selected stroking, rubbing and/or kneading massaging effects of all body parts and massage of body joints such as heels, elbows, knees and shoulders.

While the invention has been described with respect to a limited number of embodiments, it will be appreciated that many variations, modifications and other applications of the invention may be made.

What is claimed is:

1. A joints massage device comprising:

(a) a shaft housing engaging a main rotating shaft, said shaft housing being formed suitable to grip by a user; and (b) a massage head being engaged by said shaft, rotating therewith, said massage head including at least one massage element, each of said at least one massage elements being peripherally connected to said head via a hinge, and rotating therewith, each of said at least one massage elements having an extended arm, said extended arm being supplemented with a skin engaging member, said skin engaging members being positioned such that a space is formed therebetween, said space being dimensioned suitable for accommodating a massaged body joint, each of said at least one massage element being biased inwardly towards a central longitudinal axis of said massage head, such that said at least one massage element adapted is to be pushed periherally by said body joint against resistance.

2. A body massage device as in claim 1, wherein said engagement of said massage head by said shaft is effected by a quick release mechanism.

* * * * *

UNITED STATES PATENT AND TRADEMARK OFFICE

CERTIFICATE OF CORRECTION

PATENT NO. : 6,251,089 B1
DATED : June 26, 2001
INVENTOR(S) : Kuznets et al.

It is certified that error appears in the above-identified patent and that said Letters Patent is hereby corrected as shown below:

Title page,
After item [87], PCT Pub. No.: WO97/34561
PCT Pub. Date: Sep. 25, 1997
insert:

-- Related U.S. Application Data

[63] Continuation of Application No. 08/619,449 filed on March 19, 1996 now Pat. No. 5,803,916. --

Signed and Sealed this

Thirtieth Day of April, 2002

*Attest:*

*Attesting Officer*

JAMES E. ROGAN
*Director of the United States Patent and Trademark Office*